US007836659B1

(12) United States Patent
Barnes

(10) Patent No.: US 7,836,659 B1
(45) Date of Patent: Nov. 23, 2010

(54) METHOD OF REPAIRING CONCRETE FLOORS AND SYSTEM FOR SAME

(76) Inventor: Audrey Barnes, P.O. Box 490243, Lawrenceville, GA (US) 30049

( * ) Notice: Subject to any disclaimer, the term of this patent is extended or adjusted under 35 U.S.C. 154(b) by 0 days.

(21) Appl. No.: 12/787,577

(22) Filed: May 26, 2010

Related U.S. Application Data

(63) Continuation-in-part of application No. 11/649,554, filed on Jan. 4, 2007.

(51) Int. Cl.
*E04B 1/00* (2006.01)

(52) U.S. Cl. ..... 52/742.14; 52/742.1; 52/514.5; 52/220.6; 52/232

(58) Field of Classification Search ..... 52/514, 52/514.5, 741.1, 742.1, 741.4
See application file for complete search history.

(56) References Cited

U.S. PATENT DOCUMENTS

| | | | | | |
|---|---|---|---|---|---|
| 1,809,613 | A | | 6/1931 | Walker | |
| 2,010,569 | A | | 8/1935 | Sitzler | |
| 2,190,532 | A | * | 2/1940 | Lukomski | 210/164 |
| 3,289,374 | A | * | 12/1966 | Metz | 52/514 |
| 3,298,653 | A | * | 1/1967 | Omholt | 248/508 |
| 3,344,011 | A | * | 9/1967 | Goozner | 428/67 |
| 3,543,459 | A | * | 12/1970 | Mills | 52/169.11 |
| 3,575,372 | A | * | 4/1971 | Emberson | 248/501 |
| 3,603,048 | A | | 9/1971 | Hadfield | |
| 3,736,713 | A | * | 6/1973 | Flachbarth et al. | 52/220.1 |
| 3,896,511 | A | * | 7/1975 | Cuschera | 4/288 |
| 3,911,635 | A | | 10/1975 | Traupe | |
| 4,146,939 | A | * | 4/1979 | Izzi | 4/286 |
| 4,258,606 | A | * | 3/1981 | Wilson | 411/406 |
| 4,270,318 | A | | 6/1981 | Carroll et al. | |
| 4,432,465 | A | * | 2/1984 | Wuertz | 220/235 |
| 4,620,330 | A | * | 11/1986 | Izzi, Sr. | 4/288 |
| 4,620,407 | A | * | 11/1986 | Schmid | 52/745.09 |
| 4,693,652 | A | * | 9/1987 | Sweeney | 411/23 |
| 4,780,571 | A | * | 10/1988 | Huang | 174/484 |
| 4,807,843 | A | * | 2/1989 | Courtois et al. | 249/61 |
| 4,879,771 | A | * | 11/1989 | Piskula | 4/256.1 |
| 5,035,097 | A | * | 7/1991 | Cornwall | 52/220.8 |
| 5,072,557 | A | * | 12/1991 | Naka et al. | 52/126.6 |
| 5,121,579 | A | * | 6/1992 | Hamar et al. | 52/582.1 |
| 5,456,050 | A | * | 10/1995 | Ward | 52/220.8 |
| 5,479,745 | A | * | 1/1996 | Kawai et al. | 52/126.6 |
| 5,528,867 | A | * | 6/1996 | Thompson | 52/125.5 |
| 5,878,448 | A | * | 3/1999 | Molter | 4/613 |
| 5,957,619 | A | * | 9/1999 | Kinoshita et al. | 404/31 |
| 6,088,972 | A | * | 7/2000 | Johanneck | 52/100 |
| 6,189,573 | B1 | * | 2/2001 | Ziehm | 138/89 |

(Continued)

*Primary Examiner*—Richard E Chilcot, Jr.
*Assistant Examiner*—Alp Akbasli
(74) *Attorney, Agent, or Firm*—Baker Donelson

(57) ABSTRACT

A floor plug (40) is disclosed having an upper portion (41) with a top plate (44) and a neck (48), a lower portion (42) with a bottom plate (51), and post (32) which coupled the two portions together and draws them towards each other sandwiching the floor therebetween. The upper portion is positioned within the bore hole (20) and the lower portion is coupled to the post so as to be threadably drawn against the underside of the floor. Once the adhesive has cured a viscous smoothing compound or concrete floor leveler is poured over the floor plug upper portion and surrounding concrete floor area. If necessary, the concrete floor leveler material is smoothed to provide a generally smooth or level surface.

18 Claims, 4 Drawing Sheets

U.S. PATENT DOCUMENTS 6,350,373 B1 * 2/2002 Sondrup ..... 210/164
6,439,817 B1 * 8/2002 Reed ..... 411/110
6,443,495 B1 * 9/2002 Harmeling ..... 285/56
6,862,863 B2 * 3/2005 McCorkle et al. ..... 52/787.1
6,905,650 B2 * 6/2005 McIntosh et al. ..... 264/554
7,210,557 B2 * 5/2007 Phillips et al. ..... 181/207
7,222,460 B2 * 5/2007 Francies et al. ..... 52/3
7,225,824 B2 * 6/2007 West et al. ..... 137/15.01
7,278,450 B1 * 10/2007 Condon ..... 138/89
7,287,738 B2 * 10/2007 Pitlor ..... 248/544
7,441,375 B2 * 10/2008 Lang ..... 52/125.5
7,665,272 B2 * 2/2010 Reen ..... 52/742.14
2004/0113390 A1 * 6/2004 Broussard, III ..... 280/415.1
2005/0120660 A1 * 6/2005 Kim et al. ..... 52/514
2005/0155305 A1 * 7/2005 Cosenza et al. ..... 52/317
2005/0193660 A1 * 9/2005 Mead ..... 52/263
2006/0010817 A1 * 1/2006 Shull ..... 52/514
2007/0137135 A1 * 6/2007 Shymkowich ..... 52/698

* cited by examiner

METHOD OF REPAIRING CONCRETE FLOORS AND SYSTEM FOR SAME

REFERENCE TO RELATED APPLICATION

This is a continuation-in-part of U.S. patent application Ser. No. 11/649,554 filed Jan. 4, 2007.

TECHNICAL FIELD

This invention relates to a method of repairing a hole in a concrete floor and a system for repairing such.

BACKGROUND OF THE INVENTION

Concrete floors are oftentimes drilled or cored to form a bore hole through which electrical wiring or plumbing pipes are passed. Oftentimes, the reconfiguration of an office space requires that these wires or pipes be relocated, leaving a hole in the floor. As such, these holes must be repaired or filled so that an overlying carpet or tile may be placed over the hole.

One method of repairing a bore hole has been to place a filling material into the hole and then applying a viscous smoothing compound over the hole. The smoothing compound then hardens to provide a finished surface.

It is seen that a need exists for a method of repairing a hole within a concrete floor that provides a supporting surface. It is to the provision of such therefore that the present invention is primarily directed.

SUMMARY OF THE PRESENT INVENTION

In a preferred form of the invention, a method of repairing a hole within a concrete floor comprises the steps of (a) providing a plug upper portion having a top plate of a size larger than the hole in the concrete floor and a neck of a size smaller than the hole in the concrete floor; (b) positioning the neck of the plug within the hole of the concrete floor and abutting the top plate against the top surface of the concrete floor surrounding the hole; (c) providing a plug lower portion having a bottom plate larger than the hole in the concrete floor; (d) providing coupling means for coupling the plug upper portion with the plug lower portion and for drawing the top plate and the bottom plate towards each other and into contact with the floor, and (e) engaging the coupling means so as to draw the top plate and bottom plate together thereby locking the floor therebetween.

In another preferred form of the invention, a concrete floor repairing system for repairing a hole in concrete comprises a plug upper portion with a top plate of a size larger than the hole in the concrete and a neck extending from the top plate, the neck having a size smaller than the hole in the concrete; The system also includes a plug lower portion with a bottom plate of a size larger than the hole in the concrete, and a coupler coupled to the plug upper portion and the plug lower portion. The coupler is configured to draw the plug upper portion and the plug lower portion towards each other.

DETAILED DESCRIPTION

Figure 1:
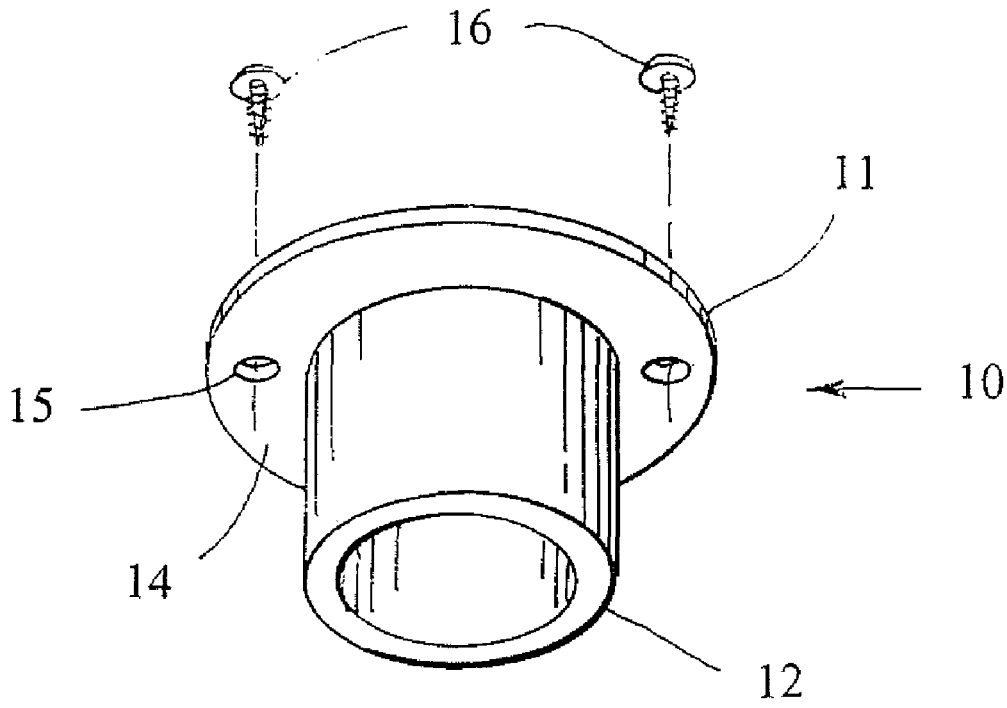
FIG. 1 is a perspective view of a floor plug that embodies principles of the invention in a preferred form.

With reference next to the drawings, there is shown a floor plug 10 in a preferred form of the invention. The floor plug 10 includes a round, generally planar top plate 11 and a cylindrical neck 12 depending from the top plate 11. The diameter of the neck 12 is smaller than that of the top plate 11 so that the a portion of the top plate 11 forms a lip portion or lip 14 extending beyond the neck 12. The top plate 11 may include one or more mounting holes 15 through which mounting screws 16 may pass. Preferably, the floor plug is made of a galvanized metal, however, the plug may also be made of other suitable materials including, but not limited to, other metal, polymer, resin or plastic materials.

In use, an adhesive 19 is applied to the underside of the top plate lip 14 and the floor plug 10 is positioned so that its neck 12 fits within the bore hole 20 within a concrete floor 21. The adhesive 19 may also have a fire barrier property, such as Fire Barrier Sealant IC 15WB, made by 3M Company of St. Paul, Minn. The size of the floor plug should be chosen so that the spacing between the neck and the bore hole is minimal, thereby providing the best fit therebetween. The floor plug lip 14 overhangs or is positioned over the surrounding concrete floor 21 defining the bore hole to prevent the floor plug from passing completely through the bore hole 20. Mounting screws 16 may be passed through mounting holes 15 and into pre-drilled holes within the underlying concrete floor to help stabilize the floor plug. It should be understood that the use of the adhesive and/or the mounting screws is optional.

Once the adhesive has cured a viscous smoothing compound or concrete floor leveler 22, such as DAP Bondex Concrete Floor Leveler, made by Dap Brands Company of Baltimore, Md., is poured over the floor plug 10 and surrounding concrete floor area 21. If necessary, the concrete floor leveler material is smoothed to provide a generally smooth or level surface, the term generally being utilized since it is obvious that the floor cannot be absolutely smooth or level due to the minimal presence of the top plate and/or variations in the materials.

Once the concrete floor leveler has cured or dried to a hardened state, a finished flooring material, such as carpet or tile, may be overlaid upon the finished concrete floor.

Figure 5:
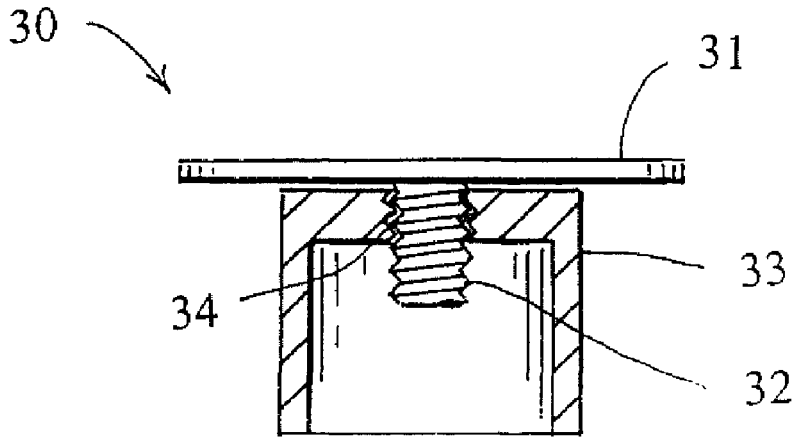
FIG. 5 is a side view, shown in partial cross-section, of a floor plug in another preferred form of the invention.
Figure 2:
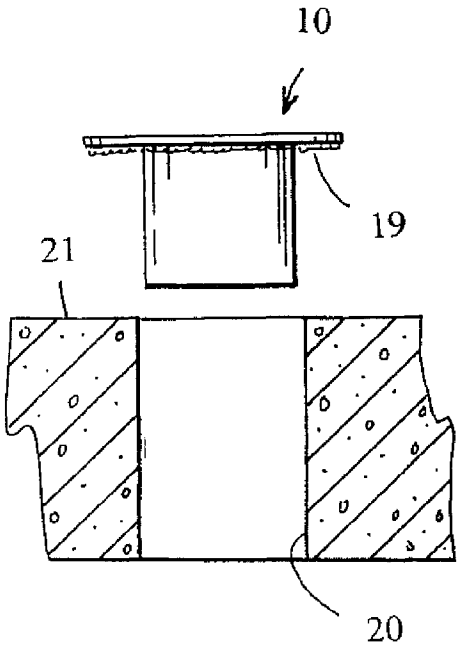
FIGS. 2-4 show a sequence of side views showing a method of repairing a hole in a floor, shown in cross-section, that embodies principles of the invention in a preferred form.
Figure 3:
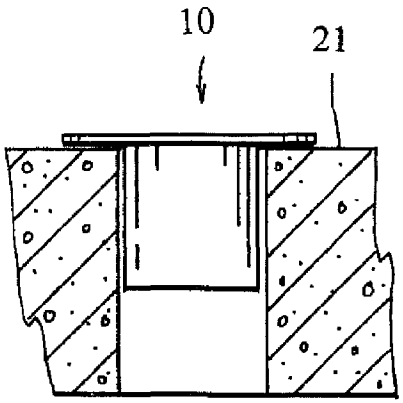
Figure 4:
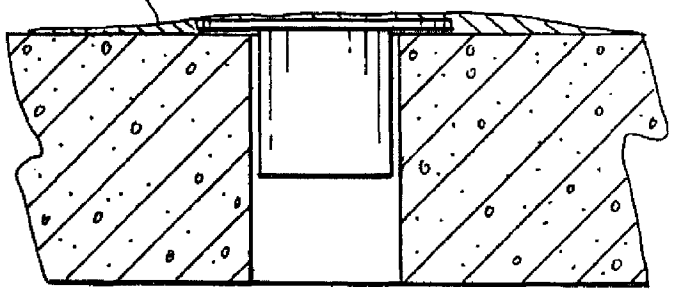

With reference next to FIG. 5, there is shown a floor plug 30 in another preferred form of the invention. Here, the floor plug has a top plate 31 and an externally threaded post 32 depending from the top plate. The floor plug 30 also includes a neck 33 having an internally threaded mounting hole 34 configured to threadably mate with the threaded post 32. Here, an operator may choose from a variety of neck diameters and simply thread the appropriate neck 33 upon the threaded post 32 to form a complete floor plug. The removable neck allows for more flexibility and less overhead associated with the storage of multiple floor plugs.

It should be understood that the top plate 11 may be configured in any form and is not limited to the round shape of the preferred embodiment. It should also be understood that the neck may also be solid and is not limited to a tubular structure.

Figure 6:
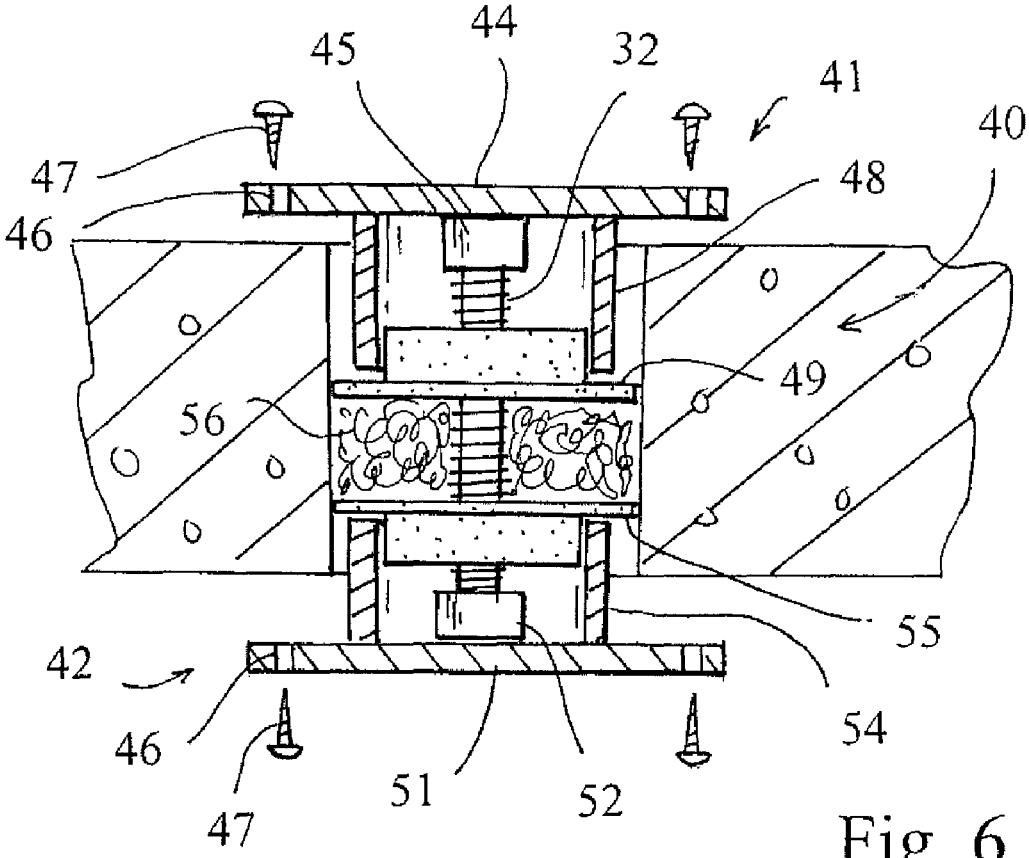
FIG. 6 is a side view, shown in partial cross-section, of a floor plug in another preferred form of the invention.

With reference next to FIG. 6, there is shown a floor plug 40 in another preferred form of the invention. Here, the floor plug 40 has an upper portion 41 and a lower portion 42. The upper portion 41 has a top plate 44 and an externally threaded post 32 threadably coupled to the top plate through an internally threaded nut 45 mounted to the top plate 44. The top plate 44 includes mounting holes 46 and mounting screws 47 as previously described. The upper portion 41 also includes a neck 48 and a water restricter or barrier 49 in the form of a pipe gasket compression seal, such as that made by Fernco, Inc. Of Davison, Mich.

The lower portion 42 similarly includes a bottom plate 51 and an internally threaded nut 52 mounted to the bottom plate and configured to threadably engage the externally threaded post 32. The bottom plate includes mounting holes 46 and mounting screws 47 as previously described. The lower portion 42 also includes a neck 54 and a water barrier 55 in the form of a pipe gasket compression seal. A fire retardant 56, for example the fire containment insulation mineral wool fire retardant made by Thermafiber, Inc. of Wabash, Ind., is positioned between the upper and lower portions. A intumescent seal made of a fire resistive material, such as Fire Barrier Moldable Putty made by 3M Company of St. Paul, Minn., is positioned between the plates 44 and 51 and the floor.

In use, the post 32 is threaded into nut 45 and the upper portion neck and water barrier are pushed into the floor hole. Next, from beneath the floor, an installer places the fire retardant 56 into the hole and then threads the lower portion nut 52 onto the bottom end of the post 32. The lower portion is rotated so that it is drawn upwardly until it fits snugly against the bottom surface of the floor, i.e., the upper and lower portions are drawn towards each other sandwiching the floor therebetween. Mounting screws 47 are then passed through mounting holes 46 in the top and bottom plates and into the floor to fix their positions. The water barriers 49 and 55 provide a water seal while the fire retardant 56 aids in restricting the spread of fire from one floor to another.

Figure 7:
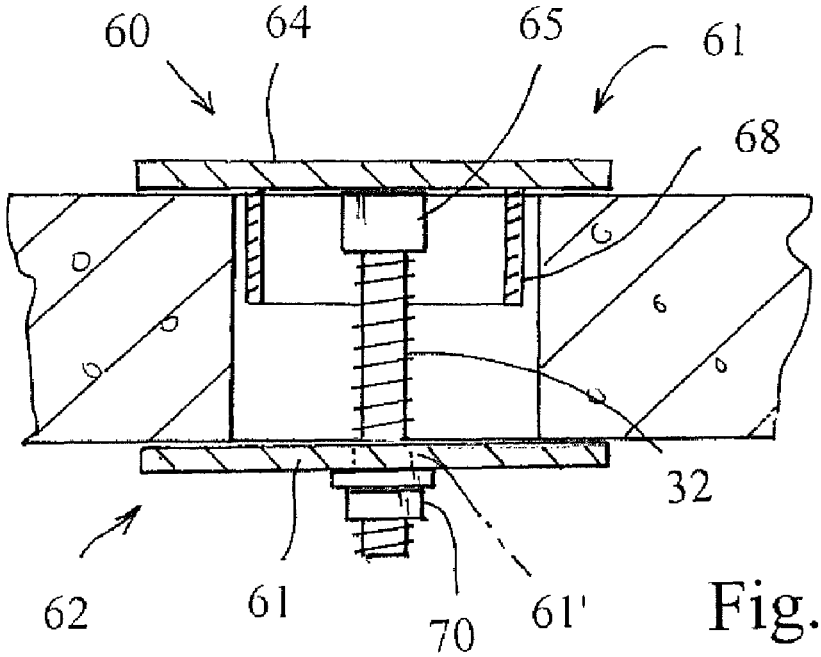
FIG. 7 is a side view, shown in partial cross-section, of a floor plug in another preferred form of the invention.

With reference next to FIG. 7, there is shown a floor plug 60 in another preferred form of the invention. Here, the floor plug 60 has an upper portion 61 and a lower portion 62. The upper portion 61 has a top plate 64 and an externally threaded post 32 threadably coupled to the top plate through an internally threaded nut 65 mounted to the top plate 64. The top plate 64 may include mounting holes and mounting screws as previously described. The upper portion 61 also includes a neck 68.

The lower portion 62 similarly includes a bottom plate 61 with a central hole 61' and an internally threaded nut 70 configured to threadably engage the externally threaded post 32. The bottom plate may include mounting holes and mounting screws as previously described. The floor plug may include a fire retardant, for example the fire containment insulation mineral wool fire retardant made by Thermafiber, Inc. of Wabash, Ind., is positioned between the upper and lower portions.

In use, the post 32 is threaded into nut 65 and the upper portion neck and water barrier are pushed into the floor hole. Next, from beneath the floor, an installer threads the post 32 through hole 61' and then threads the lower portion nut 70 onto the bottom end of the post 32. The lower portion is rotated so that it is drawn upwardly until it fits snugly against the bottom surface of the floor.

Figure 8:
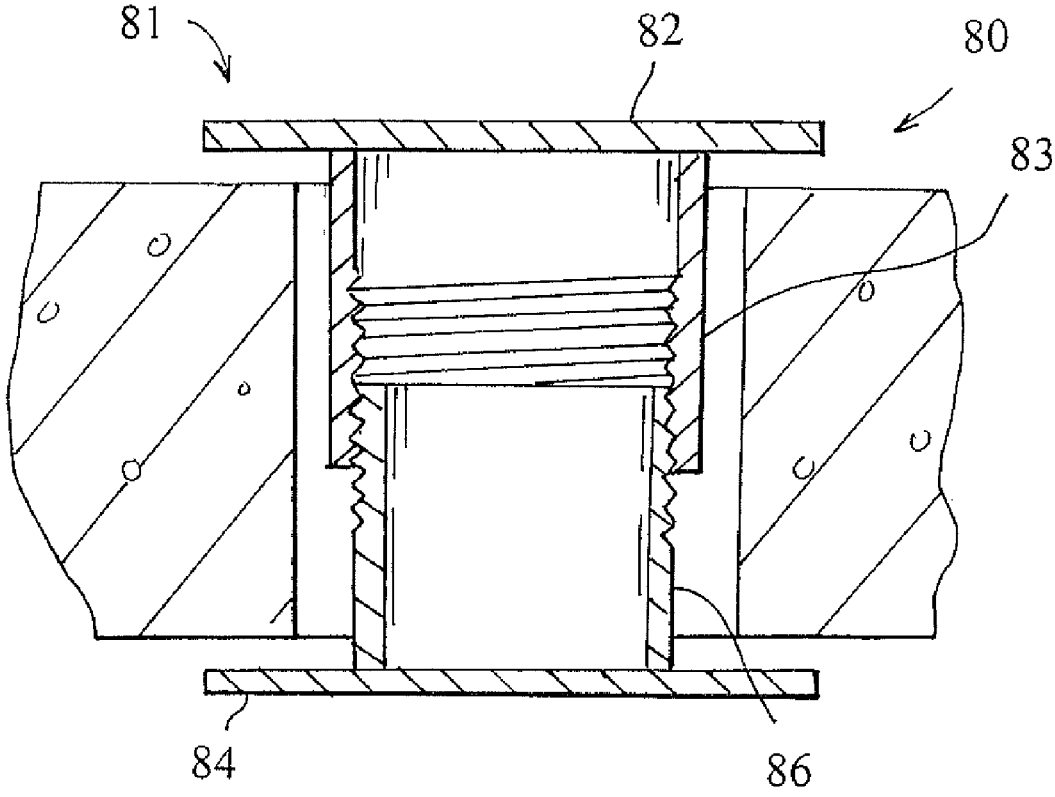
FIG. 8 is a side view, shown in partial cross-section, of a floor plug in another preferred form of the invention.

With reference next to FIG. 8, there is shown a floor plug 80 in another preferred form of the invention. Here, the floor plug 80 has an upper portion 81 and a lower portion 82. The upper portion 81 has a top plate 82 and an internally threaded neck 83.

The lower portion 82 similarly includes a bottom plate 84 and an externally threaded neck 86 configured to mesh with the internally threaded neck 83 of the upper portion. Water and fire resistant material may be added to this embodiment also, as well as the mounting holes and screws.

In use, the neck 83 of the upper portion 81 is placed within the floor hole. Next, from beneath the floor, an installer threads the neck 86 of the lower portion into the neck 83 of the upper portion so that it is drawn upwardly until it fits snugly against the bottom surface of the floor.

It should be understood that with all embodiment described herein, the process of smoothing the floor after the plug is fixed in position may occur as previously described. Similarly, the use of a water barrier and/or fire resistant barrier may be used with any embodiment described herein.

It thus is seen that a system for repairing a cement floor and a method of repairing a cement floor is now provided. While this invention has been described in detail with particular references to the preferred embodiments thereof, it should be understood that many modifications, additions and deletions, in addition to those expressly recited, may be made thereto without departure from the spirit and scope of the invention as described by the following claims.

The invention claimed is:

1. A method of repairing a hole within a concrete floor, the method comprising the steps of:

(a) providing a plug upper portion having a top plate of a size larger than the hole in the concrete floor and a neck of a size smaller than the hole in the concrete floor;

(b) positioning the neck of the plug within the hole of the concrete floor and abutting the top plate against the top surface of the concrete floor surrounding the hole (c) providing a plug lower portion having a bottom plate larger than the hole in the concrete floor;

(d) providing coupling means for coupling the plug upper portion with the plug lower portion and for drawing the top plate and the bottom plate towards each other and into contact with the floor, and (e) engaging the coupling means so as to draw the top plate and bottom plate together thereby locking the floor therebetween.

2. The method of claim 1 further comprising the steps of (f) overlaying the plug top plate and a portion of the concrete floor surrounding the hole with a viscous leveler;

(g) smoothing the viscous leveler; and (h) allowing the viscous leveler to cure to a hardened state.

3. The method of claim 1 further comprising the step of positioning a fire retardant material between the top plate and the bottom plate.

4. The method of claim 3 further comprising the step of positioning a water restricter between the top plate and the bottom plate.

5. The method of claim 1 further comprising the step of positioning a water restricter between the top plate and the bottom plate.

6. The method of claim 5 further comprising the step of positioning a fire retardant material between the top plate and the bottom plate.

7. The method of claim 1 wherein said lower portion includes a neck coupled to the bottom plate.

8. The method of claim 7 wherein the coupling means consists of the upper portion neck and the lower portion neck being mateably threadable to each other.

9. The method of claim 1 wherein the coupling means comprises a threaded post threadably coupled to at least one of the upper portion or the lower portion.

10. A concrete floor repairing system for repairing a hole in concrete comprising:

a plug upper portion with a top plate of a size larger than the hole in the concrete and a neck extending from said top plate, said neck having a size smaller than the hole in the concrete;

a plug lower portion with a bottom plate of a size larger than the hole in the concrete, and a coupler coupled to said plug upper portion and said plug lower portion, said coupler being configured to draw said plug upper portion and said plug lower portion towards each other.

11. The concrete floor repairing system of claim 10 further comprising a concrete leveling compound adapted to overlay said plug and a portion of the concrete floor in a viscous form and then be cured to a hardened state, whereby the plug upper portion is placed so that the plug upper portion neck is positioned within the concrete hole and a portion of the plug upper portion top plate overlying the surrounding concrete, and the concrete leveling compound covers the plug upper portion to provide a generally even or smooth surface.

12. The concrete floor repairing system of claim 10 further comprising fire retardant material positioned between said top plate and said bottom plate.

13. The concrete floor repairing system of claim 12 further comprising a water restricter positioned between said top plate and said bottom plate.

14. The concrete floor repairing system of claim 10 further comprising a water restricter positioned between said top plate and said bottom plate.

15. The concrete floor repairing system of claim 14 further comprising a fire retardant material positioned between said top plate and said bottom plate.

16. The concrete floor repairing system of claim 10 wherein said lower portion includes a neck coupled to the bottom plate.

17. The concrete floor repairing system of claim 16 wherein said coupler comprises said upper portion neck and said lower portion neck being mateably threadable to each other.

18. The concrete floor repairing system of claim 10 wherein said coupler comprises a threaded post threadably coupled to at least one of the upper portion or the lower portion.

* * * * *